United States Patent [19]

Shekel et al.

[11] 4,373,763

[45] Feb. 15, 1983

[54] AUXILIARY CONNECTOR INCLUDING FLIP ADAPTER

[75] Inventors: Joseph Shekel, New York; Joseph DeStefano, Carle Place, both of N.Y.

[73] Assignee: Auto-Line Manufacturing Corp., Copaigue, N.Y.

[21] Appl. No.: 262,197

[22] Filed: May 11, 1981

[51] Int. Cl.[3] ..... H01R 11/24; H01R 27/00

[52] U.S. Cl. ..... 339/31 B; 339/29 B; 339/95 B; 339/228

[58] Field of Search ..... 339/28, 29 R, 29 B, 339/95 B, 224, 258 R, 258 C, 228, 261

[56] References Cited

U.S. PATENT DOCUMENTS

| | | | |
|---|---|---|---|
| 1,492,657 | 5/1924 | Walker | 339/261 |
| 1,821,443 | 9/1931 | Mohr | 339/258 C |
| 3,745,516 | 7/1973 | Lieberman | 339/258 R X |
| 4,006,952 | 2/1977 | Puckett | 339/29 B X |
| 4,082,401 | 4/1978 | Kruzecki | 339/224 X |

*Primary Examiner*—Eugene F. Desmond

*Attorney, Agent, or Firm*—Auslander, Thomas & Morrison

[57] ABSTRACT

An adapter for adapting auxiliary connectors to side terminal batteries includes a portion which flips from a stored position against the exterior of one of the jaws of the auxiliary connector to an operative position between the jaws with a connector portion extending forward for attachment to the side terminal of a side terminal battery. A pair of slots in the flip adapter are engaged by a pair of teeth in the opposed jaw of the auxiliary connector to hold the flip adapter rigidly in its operative position.

4 Claims, 5 Drawing Figures

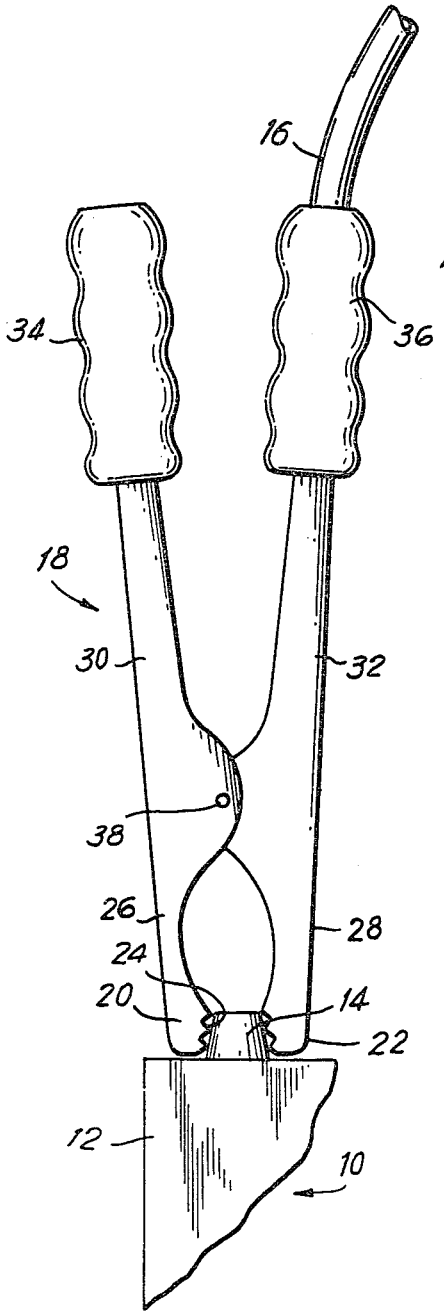
FIG. 1
PRIOR ART
FIG. 2
PRIOR ART
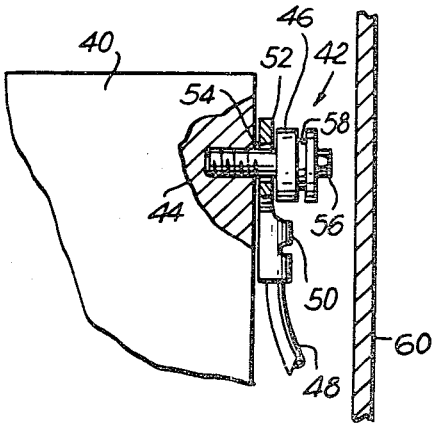

AUXILIARY CONNECTOR INCLUDING FLIP ADAPTER

CROSS REFERENCE TO RELATED APPLICATIONS

The present application is related to U.S. patent applications Ser. Nos. 153,156 and 207,913.

BACKGROUND OF THE INVENTION

The present invention relates to auxiliary connectors for connecting auxiliary cables to battery terminals and more particularly, to adapters for permitting connection of auxiliary connectors to side-terminal batteries.

In the past, conventional batteries such as, for example, lead-acid batteries for use in motor vehicles, included terminal posts projecting upward from the top of the battery. Such terminal posts were convenient for clamping or otherwise attaching booster or charging auxiliary cables employing clamp type auxiliary connectors having a pair of opposed resiliently urged jaws such as shown in U.S. Pat. Nos. 4,145,648 and 4,163,134.

More recently, side-terminal batteries have become available in which, instead of having terminal posts projecting upward where they can be reached for connection of auxiliary connectors, such batteries have terminal bolts screwed into threaded positive and negative terminal receptacles on the side walls of the battery. The receptacles project, at the most, only slightly beyond the side wall of the battery, thus making it difficult or impossible to engage side battery terminals with traditional gripping jaws of auxiliary connectors. This difficulty is further compounded by the fact that most vehicle batteries are retained in a metallic battery container having close clearance to the side of the battery and making it difficult or impossible to obtain access for the attachment of the clamping jaws of an auxiliary connector.

In order to attempt to overcome this difficulty, an auxiliary clamp for side-battery terminals has been disclosed in U.S. Pat. No. 3,745,516 which has one end adapted to engage a side-battery terminal and a second end projecting above the battery upon which conventional gripping jaws of an auxiliary connector may be clamped. Such an adapter is a small free item which is easily misplaced under conditions normal for storage of auxiliary battery cables when not in use.

A further solution is proposed in U.S. patent application Ser. No. 153,156 in which a side terminal adapter is pivoted to rotate in a plane parallel to the jaws of a clamp-type auxiliary connector.

Another solution is proposed in U.S. patent application Ser. No. 207,913 in which a flip adapter is hinged to one of the jaws of a clamp-type auxiliary connector and one end of it is rotated or flipped between the jaws which grasp it and hold it in a position for use.

OBJECTS AND SUMMARY OF THE INVENTION

It is an object of the present invention to provide an adapter for an auxiliary connector for permitting connection of the auxiliary connector to side-terminal batteries.

It is a further object of the invention to provide an adapter for an auxiliary connector which is rotatable from an inoperative position against the outside of one of the jaws of the connector into an operative position wherein a portion of it is grasped in a three-point grasp between the jaws of the auxiliary connector and a slotted portion extends forward of the jaws to engage a side terminal of a side terminal battery for permitting connection of the auxiliary connector to the side terminal battery.

It is a still further object of the invention to provide means in a flip adapter for firmly locking the flip adapter in its operative position employing slots in a top portion of the flip adapter engaged by teeth in the opposite jaw.

According to an aspect of the present invention, there is provided an auxiliary connector for connection to a top terminal battery and a side terminal battery comprising first and second opposed jaws, means for resiliently urging the first and second opposed jaws together whereby they are effective for grasping a top terminal of a top terminal battery, an adapter hinged to the first jaw and hingeable between first and second positions, the first position being an inoperative position wherein the adapter is disposed against an outer surface of the first jaw, the second position being an operative position wherein the adapter projects from between the first and second opposed jaws and includes attachment means effective to engage a side terminal of a side terminal battery, means for locking the adapter in the second position, the means for locking including at least one tooth on the second jaw and at least one locking slot in the adapter, the locking slot being aligned with, and entered by, the at least one tooth when the first and second jaws are permitted to move together while the adapter is in the second position whereby hinging of the adapter from the second position is prevented.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 is a side elevation showing a portion of a top terminal battery to which is attached an auxiliary connector of an auxiliary cable;

FIG. 2 is a side elevation of a side terminal battery showing details of the side terminal with a battery cable attached thereto;

DETAILED DESCRIPTION OF THE PREFERRED EMBODIMENTS

Figure 3:
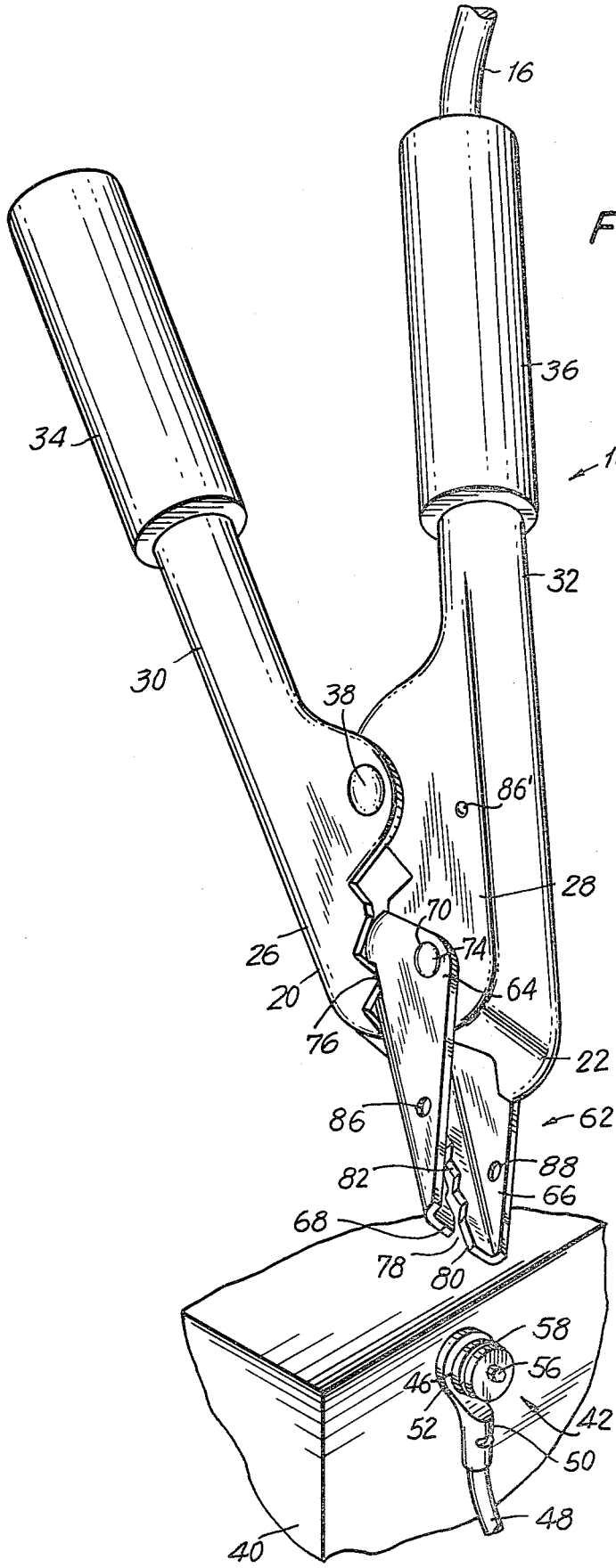
FIG. 3 is a perspective view of a side terminal battery and an auxiliary connector including an adapter according to the present invention in position to be clamped over the side terminal.

Before beginning a description of the present invention, a brief discussion of conventional auxiliary battery cable connectors usable with conventional top terminal batteries will be given with reference to FIG. 1.

A conventional top terminal battery 10 includes a case 12, usually of insulating material. A positive or negative battery terminal 14 protrudes upward from the top of top terminal battery 10 to provide a means for connecting a conventional clamp-type battery cable connector (not shown). When it is desired to provide auxiliary power to, or receive auxiliary power from top terminal battery 10, an auxiliary cable 16 may be electrically and mechanically connected to battery terminal 14 using an auxiliary connector 18.

Auxiliary connector 18 includes a pair of opposed jaws 20 and 22 which may optionally have serrated, tooth-like facing surfaces 24 attached to lower legs 26 and 28. Upper legs 30 and 32, preferably integral with lower legs 26 and 28, respectively, form pliers-like handles for manipulating auxiliary connector 18 in attaching it to battery terminal 14. Insulating hand grips 34 and 36 may optionally be provided on upper legs 30 and 32. The assembly consisting of lower leg 26 and upper leg 30 is pivoted to the assembly consisting of lower leg 28 and upper leg 32 at a pivot 38. A resilient device, conveniently a spring (not shown) is provided for urging jaws 20 and 22 toward each other and upper legs 30 and 32 away from each other so that toothed-like surfaces 24 may form mechanical and electrical contact with battery terminal 14.

A side-terminal battery, such as battery 40 shown in FIG. 2, presents difficulties in using the auxiliary connector 18 of FIG. 1. Instead of having a top battery terminal, such as 14 in FIG. 1, side terminal battery 40 has a side terminal 42 extending from the side of battery 40.

Side terminal 42 includes a bolt portion 44 and a head portion 46. A positive or negative battery cable 48 includes an end terminal 50 having a washer-like connector 52 with a through-hole 54 therethrough.

End terminal 50 is firmly connected to battery 40 when bolt portion 44 of side terminal 42 is passed through through-hole 54 and head portion 46 is tightened against it, thus making firm electrical and mechanical contact between end terminal 50 and battery 40. An outer portion 56 of side terminal 42 may be provided with hexagonal or other flat surfaces to enable attachment of a wrench (not shown) for tightening side terminal 42 into battery 40. A circumferential groove 58 may be included in head portion 46.

Side-terminal battery 40 may be installed in a battery case having a metallic wall 60 closely adjacent side terminal 42. Alternatively, metallic wall 60 may comprise a portion of the engine compartment or other metallic structure of the vehicle. As shown in FIG. 2, the clearance between side terminal 42 and metallic wall 60 is insufficient to permit direct connection of jaws 20 and 22 of an auxiliary connector 18 as illustrated in FIG. 1.

In order to permit connection of auxiliary cables to side terminal 42 in the limited clearance space provided, an adapter 62, shown in FIG. 3, is included in an auxiliary connector 18'. Adapter 62 has a generally U-shape formed by first and second sides 64 and 66 at right angles to a center portion 68.

A pair of holes 70 are provided in sides 64 and 66 through which a pin 74 may pass including through matching holes (not shown) in jaw 22. Thus, adapter 62 is hingeable about pin 74.

In the position shown in FIG. 3, a rear portion of center portion 68 is clamped between jaws 20 and 22 to thus maintain adapter 62 firmly in the position shown in FIG. 3 under the urging of the resilient means, such as a spring (not shown) which tend to force jaws 20 and 22 together.

Center portion 68 includes a groove 78 therein shaped to fit into and grasp circumferential groove 58 in side terminal 42 (FIGS. 2 and 3). A ramp-shaped leading portion 80 (FIGS. 3 and 4) tends to spread groove 78 when pressed against side terminal 42. Teeth or serrations 82 at the edges of groove 78 thereupon grasp side terminal 42. An extension 84 (FIG. 4) of groove 78 provides additional resilience to permit spreading of groove 78 and the springback thereof as required to fit over and then grasp side terminal 42.

Figure 4:
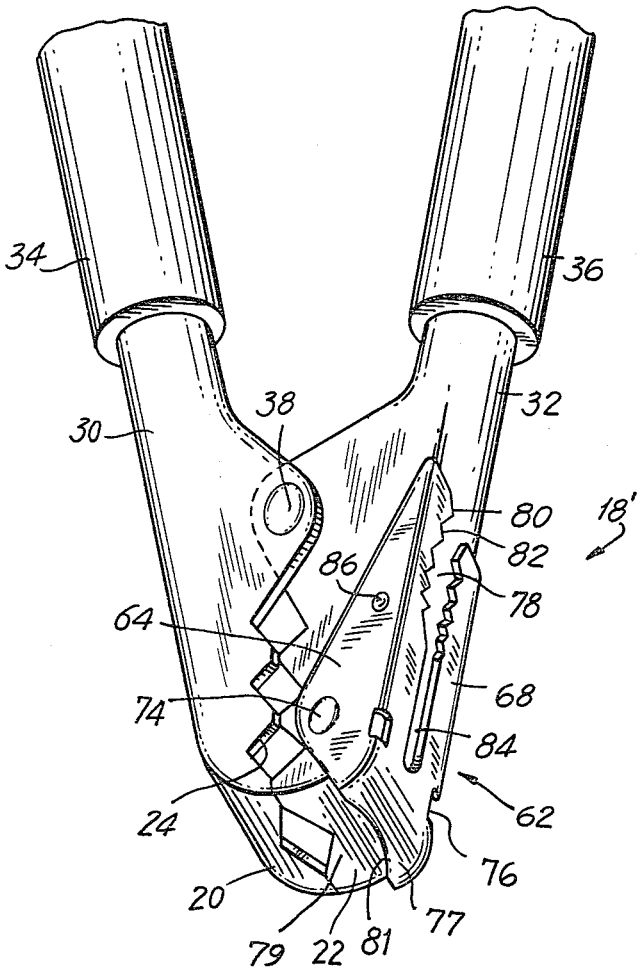
FIG. 4 is an enlarged perspective view of the auxiliary connector of FIG. 3 with the flip adapter hinged into its stowed or inoperative position.

One or more dome-shaped depressions or dimples 86 and/or 88 may be formed in sides 64 and/or 66 to produce dimples or depressions on the inside thereof which may engage coacting dimples or depressions 86' in lower leg 28 to retain adapter 62 in its inoperative position shown in FIG. 4. Alternatively, one of elements 86 or 86' may be a hole which is engaged in the inoperative position by the other thereof.

A pair of locking slots 76 are disposed in center portion 68. Locking slots 76 provide rigid support for adapter 62 when in the extended or operative position of FIG. 3 in a manner to be explained.

Center portion 68 ends in a curved end portion 77 whose center of curvature is approximately on the axis of pin 74. Jaw 22 also has a curved end portion 79 having a curvature which is also generally centered on the axis of pin 74 so that adapter 62 can be rotated from its inoperative position shown in FIG. 4 to its operative position shown in FIG. 3 without interference from curved end portion 79.

Curved end portion 77 of adapter 62 terminates in an abutment surface 81.

Figure 5:
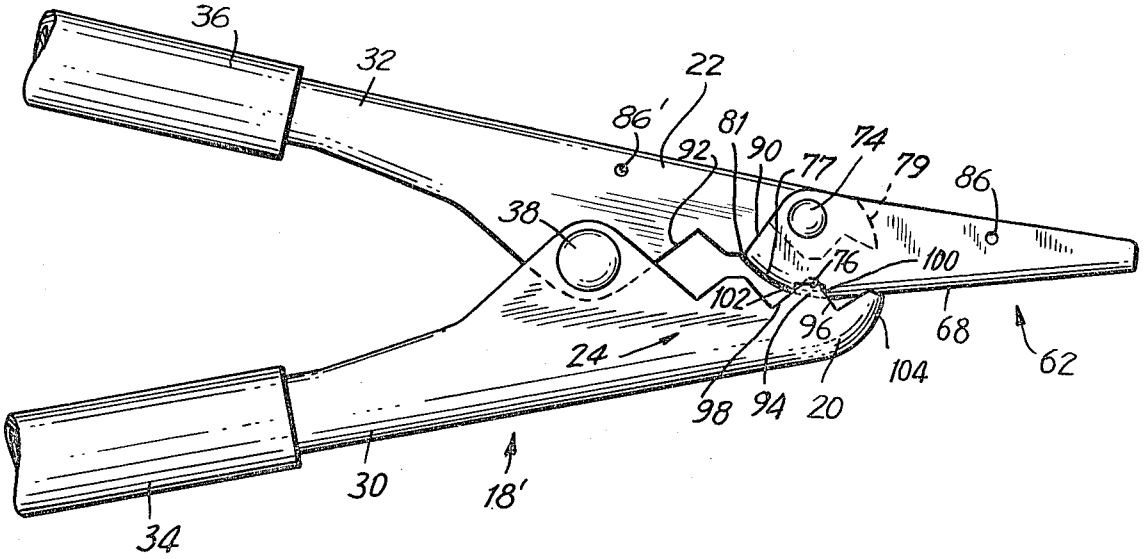
FIG. 5 is an enlarged side view of an auxiliary connector including an adapter according to the present invention.

Referring now also to FIG. 5, in order to flip adapter 62 from its inoperative position shown in FIG. 4 to its operative position shown in FIG. 3, hand grips 34 and 36 are squeezed together against the opposing force of a spring (not shown) to thus move jaws 20 and 22 apart and thus permit adapter 62 to be rotated clockwise about pivot 74 until abutment surface 81 is stopped by contact with a forward surface 90 of a rear tooth 92 on jaw 22. In this position of adapter 62, locking slots 76 are aligned with a middle tooth 94 on jaw 20.

When hand grips 34 and 36 are released, middle tooth 94 on the side visible in FIG. 5 enters locking slot 76. One of the sloping forward or rear edges 96 or 98 contacts the forward or rear ends 100 or 102 of slot 76. A forward tooth 104 on jaw 20 contacts center portion 68 and stops the closing action of jaws 20 and 22. In the closed and gripped operative position shown in FIG. 5, rotation of adapter 62 in the clockwise direction about pin 74 is resisted by abutment of abutment surface 81 against forward surface 90 of rear tooth 92 and/or by the abutment of forward edge 96 of middle tooth 94 against forward end 100 of locking slot 76. Rotation of adapter 62 in the counterclockwise direction about pin 74 is resisted by abutment of rear end 102 of locking slot 76 against rear edge 98 of middle tooth 94.

It would be clear in the light of the preceding description that corresponding parts on the opposite hidden side of auxiliary connector coact in an identical manner to that described in the preceding.

Although the abutment of abutment surface 81 with forward surface 90 of rear tooth 92 is convenient for aligning middle tooth 94 with locking slot 76, this is an inventive addition to the basic locking action contributed by middle tooth 94 engaging locking slot 76.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An auxiliary connector for connection to a top terminal battery and a side terminal battery comprising:

first and second opposed jaws;

means for resiliently urging said first and second opposed jaws together whereby they are effective for grasping a top terminal of a top terminal battery;

an adapter hinged to said first jaw and hingeable between first and second positions;

said first position being an inoperative position wherein said adapter is disposed against an outer surface of said first jaw;

said second position being an operative position wherein said adapter projects from between said first and second opposed jaws and includes attachment means effective to engage a side terminal of a side terminal battery;

means for locking said adapter in said second position;

said means for locking including at least one tooth on said second jaw and at least one locking slot in said adapter, said locking slot being aligned with, and entered by, said at least one tooth when said first and second jaws are permitted to move together while said adapter is in said second position whereby hinging of said adapter from said second position is prevented.

2. An auxiliary connector according to claim 1, further comprising an abutment surface on said flip adapter and a coacting surface on said first jaw, said coacting surface being effective to abut said abutment surface when said adapter is hinged into said second position whereby alignment between said at least one tooth and said locking slot is achieved.

3. An auxiliary connector according to claim 1, wherein said adapter includes a forward end, said adapter being hinged about an axis, said forward end being curved with a center of curvature substantially on said axis, and said abutment surface is at a perimeter of said forward end.

4. An auxiliary connector according to claim 1, 2 or 3, wherein said second jaw has at least a second tooth, said second tooth contacts a surface of said adapter in said second position.

* * * * *